US009089765B1

(12) United States Patent
Walsh

(10) Patent No.: US 9,089,765 B1
(45) Date of Patent: Jul. 28, 2015

(54) BOARD GAME ACCESSORY

(71) Applicant: Tim Walsh, San Francisco, CA (US)

(72) Inventor: Tim Walsh, San Francisco, CA (US)

( * ) Notice: Subject to any disclaimer, the term of this patent is extended or adjusted under 35 U.S.C. 154(b) by 0 days.

(21) Appl. No.: 14/503,197

(22) Filed: Sep. 30, 2014

(51) Int. Cl.
*A63F 3/00* (2006.01)

(52) U.S. Cl.
CPC ..... *A63F 3/00694* (2013.01); *A63F 2003/0063* (2013.01); *A63F 2003/00195* (2013.01); *A63F 2003/00716* (2013.01)

(58) Field of Classification Search
CPC . A63F 3/00176; A63F 3/00574; A63F 11/00; A63F 2003/00195; A63F 2003/0035; A63F 2003/0063; A63F 2003/00703; A63F 2003/00719; A63F 2003/00738; A63F 2003/00747; A63F 2009/0491
USPC ..... 273/148 A, 287
See application file for complete search history.

(56) References Cited

U.S. PATENT DOCUMENTS

| | | | | |
|---|---|---|---|---|
| 5,524,897 | A * | 6/1996 | Mastronunzio | 273/264 |
| 7,373,747 | B1 * | 5/2008 | Wiemer et al. | 40/605 |
| 2009/0100732 | A1 * | 4/2009 | Seidler | 40/729 |

* cited by examiner

*Primary Examiner* — Vishu Mendiratta
(74) *Attorney, Agent, or Firm* — Philip T. Virga

(57) ABSTRACT

A board game accessory for use in holding and displaying hexagonally shaped tile pieces is disclosed. The board game accessory comprises a hexagonally shaped frame defining interiorly shaped holding portions for use in the support and replacement of the tile pieces. Additionally, the game board accessory interiorly houses diametrically magnetized solid cylindrical two-pole magnets within each side of its frame such that board game accessory pieces may be magnetically connected and held in place when located adjacent to each other. In use, the board game accessory allows for easy initial set-up and storage while allowing for different game configurations then prior art board game accessories.

11 Claims, 5 Drawing Sheets

BOARD GAME ACCESSORY

TECHNICAL FIELD

The present invention relates to a board game accessory. More particularly, to a board game accessory for use in entertainment games having planar pathway indicia game pieces, which may during the course of the game, be arranged or otherwise configured in any suitable manner such that the visible pathway indicia collectively define one or more continuous pathways.

BACKGROUND ART

Multiplayer board games are well known that are made up of a plurality of modular parts from which the user can make up complex assemblies. These complex assemblies can be of very different types: They can be simple geometric shapes so as to make constructions by means of the simple superimposing of the parts, they can be assembled or clickable parts that once assembled have a certain resistance to dismantling, they can be puzzles, cube puzzles, etc.

The Settlers of Catan is one such multiplayer board game wherein players in the game represent settlers establishing colonies on the island of Catan. One of the objects of the game is for players to build using modular parts representing settlements, cities, and roads and to connect them as they settle the island. Referring to FIG. 1, The Settlers of Catan game board is shown representing an island wherein the modular parts are composed of hexagonal tiles (hexes) of different land types which are laid out randomly and placed adjacent to each other at the beginning of each game. Thereafter, during the course of the game one of the strategies in winning includes removing and replacing these tiles for obtaining certain game objectives and advantages.

However, the use of hexagonal tiles as modular parts in forming game boards on a horizontal space have difficulty providing structural support during initial assembly and staying assembled while in use or in storage. Previous attempts to add structural support for this game was to provide a frame around the entire game board layout, but not between each hexagonal tile of the game board. Therefore, a need exists for providing a support apparatus for each hexagonal tile individually which in use creates a modular game board system for playing "The Settlers of Catan" in a more enjoyable fashion.

SUMMARY OF THE INVENTION

A board game accessory for use in holding and displaying hexagonally shaped tile pieces is disclosed. The board game accessory comprises a hexagonally shaped frame defining interiorly shaped holding portions for use in the support and replacement of the tile pieces. Additionally, the game board accessory interiorly houses diametrically magnetized solid cylindrical two-pole magnets within each side of its frame such that board game accessory pieces may be magnetically connected and held in place when located adjacent to each other. In use, the board game accessory allows for easy initial set-up and storage while allowing for different game configurations than prior art board game accessories.

DESCRIPTION OF THE DRAWINGS

In accordance with these and other objects, which will become apparent hereinafter, the instant invention will now be described with particular reference to the accompanying drawings.

DESCRIPTION OF EMBODIMENTS

Figure 1:
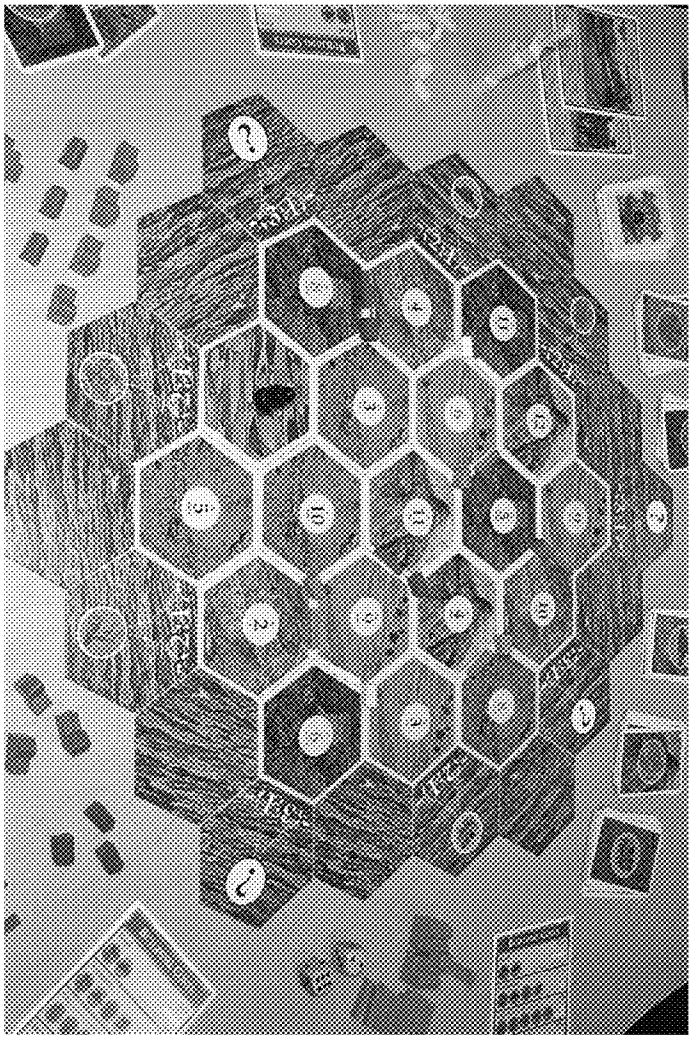
FIG. 1 is a perspective view illustrating the placement of hexagonal tile pieces that layout a game board for playing The Settlers Of Catan.
Figure 2:
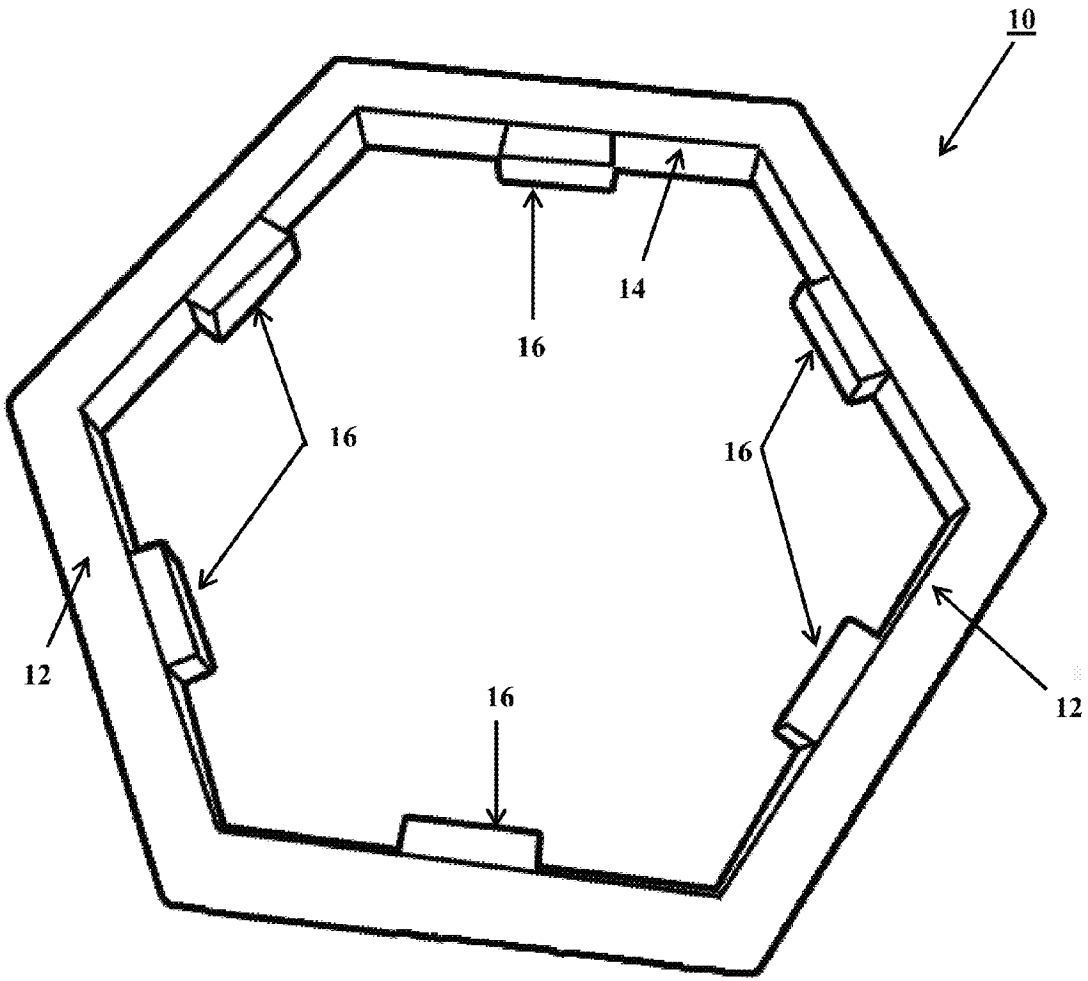
FIG. 2 is a top sided view of the board game accessory for supporting the hexagonal tiles in accordance with the present invention.

Referring now to FIG. 2, reference numeral 10 generally indicates a preferred embodiment of the board game accessory of the present invention in the form of a hexagonal frame 12. The game board accessory 10 in one preferred embodiment is a unitary piece molded from plastic but may also be formed using wood, metal or the like. Turning once again to FIG. 2, along each inner side 14 of hexagonal frame 12 are defined generally rectangular shaped holding portions 16. The interior circumference of the hexagonal frame 12 in combination with the size and placement of the holding portions 16 are dimensioned such that a hexagonally shaped tile game piece from the game, "The Settlers Of Catan" may be dropped in and supported for use during game play.

Figure 3:
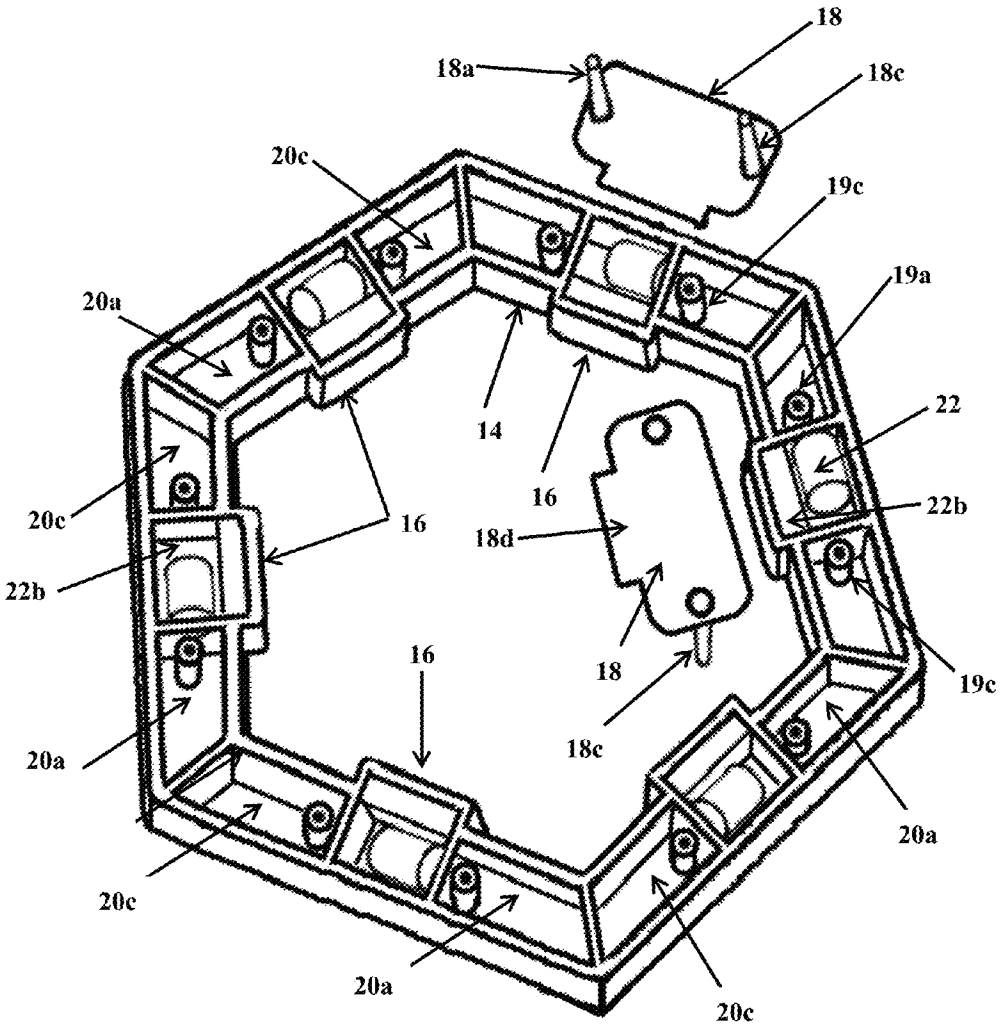
FIG. 3 is a bottom sided disassembled view illustrating the placement of magnets within the game board accessory used for holding the board game accessory pieces together.
Figure 4:
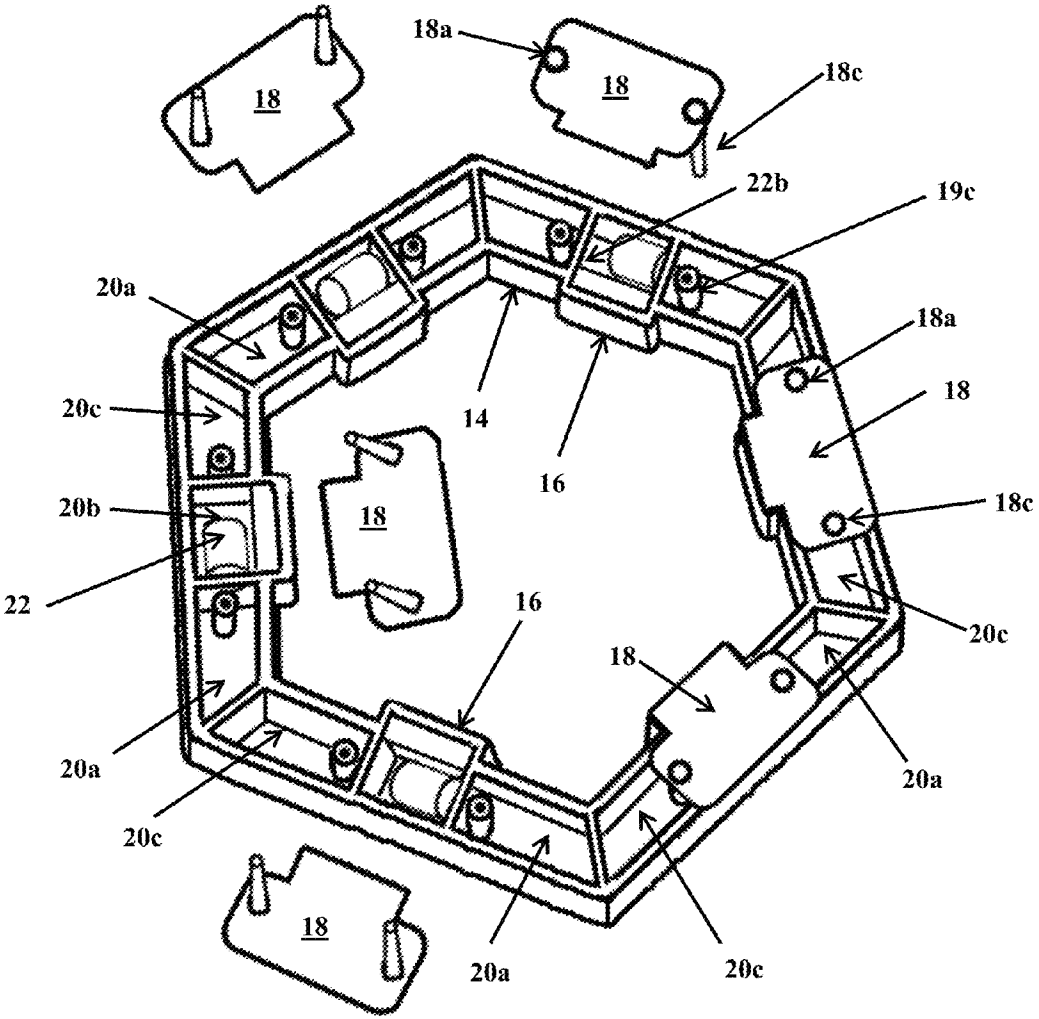
FIG. 4 is another bottom sided disassembled view illustrating the placement of magnets within the game board accessory used for holding the board game accessory pieces together.

Referring now to FIGS. 2 through 4, the bottom side of frame 12 of board game accessory 10 is shown illustrating the use of magnets 22 for holding the board game accessory pieces during game play as will be more fully described below. More particularly, the underside or bottom of frame 12 defines three cavities 20*a*, 20*b* and 20*c* respectively along each hexagonal side 14 of hexagonal frame 12. The center cavity 20*b* is dimensioned to house a cylindrical magnet 22 as will be more fully described below. On each side of cavity 20*b* are cavities 20*a* and 20*c* each defining circular receptacle receiving portions 19*a* and 19*c* for receiving holding lid portions 18 used for permanently keeping cylindrical magnets 22 housed in place.

More specifically and turning once again to FIGS. 3 and 4, lid portions 18 each define a pair of receptacle protrusions 18*a* and 18*c* located on each of the undersides of lids 18. During assembly of the board game accessory 10 of the present invention, a magnet 22 is placed in cavity 20*b* wherein the lids 18 are permanently installed by inserting the pair of receptacle protrusions 18*a* and 18*c* into the circular receptacle receiving portions 19*a* and 19*c*. It should be understood that the receptacle receiving portions 19*a* and 19*c* may be placed anywhere in their respective cavities 20*a* and 20*c* as long as the pair of receptacle protrusions 18*a* and 18*c* are placed in a matching location that allows for their insertion to fully complete the mating of lid 18 to frame 12. The mating of the lids 18 to the underside of each side 14 of frame 12 may include the use of glue or any suitable adhesive to securely keep magnets 22 housed within their cavity 22*b* by keeping lid 18 permanently attached to frame 12. In another preferred embodiment, the lids 18 may define a protrusion portion 18*d* that covers the holding portions 16, as shown in FIG. 3.

The present invention utilizes a "straight through" diametrically magnetized solid cylindrical two-pole magnet 22 housed within cavity 22*b*. More specifically, the dimension of cavity 22*b* allows the cylindrical magnet 22 to freely roll about its center axis. By housing a cylindrically shaped diametrically magnetized magnet interiorly into each side 14 of frame 12, the placement of any board game accessory 10 next to and adjacent to any other board game accessory 10 connects the game board accessory to be held together since the magnets housed within each frame 12 will roll into a position that will magnetically connect them to each other.

By way of example, but not of limitation an example of on type of diametrically magnetized solid cylindrical two-pole magnet 22 are "neodymium cylinder magnets" sold by K & J Magnets Inc., wherein the dimensions of these magnets are ⅛"×¼" and are suitably sized for use with frame 12. It should be understood that the cavities 20*b* are dimensioned that allowed the magnets 22 movement necessary for the board game accessory to function to create a game board in accordance with the present invention. If the magnets were to be held firmly in place then they have the possibility of repelling other pieces when assembling the board, which is why the diametric polarization is important.

Figure 5:
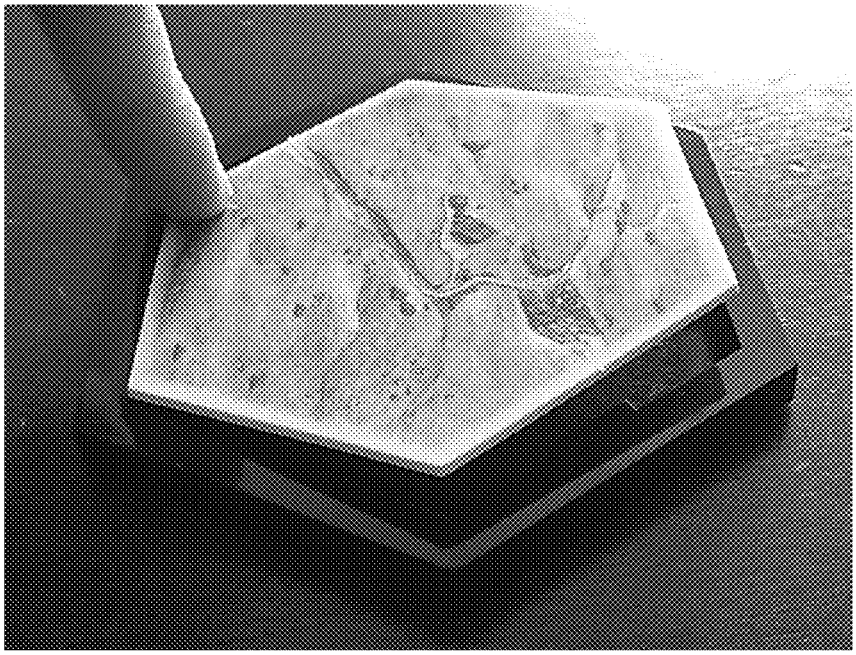
FIG. 5 is a perspective view illustrating how a hexagonal game tile may be removed and replaced with another hexagonal game tile using the board game accessory in accordance with the present invention.
Figure 6:
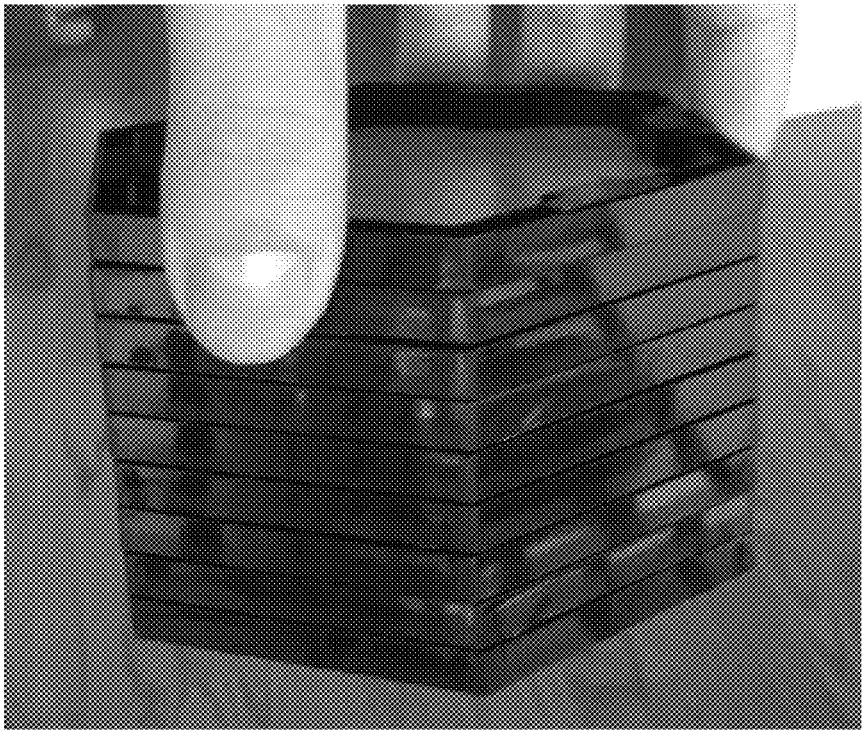
FIG. 6 is a side view illustrating how the board game accessory pieces may be stored after use by stacking the board game accessory pieces on top of each other.

Referring now to FIG. 5, there is shown yet another preferred embodiment in using the board game accessory 10 of the present invention. More specifically, the dimensional shape and location of the holding portion 16 within frame 12 allows for a tile piece to be "flipped" or lifted out of board game accessory 10 by applying a slight pressure to any side of a game tile for revealing a tile in that location wherein by flipping it over it may be placed back into the board game accessory 10. Referring now to FIG. 6, there is shown still yet another embodiment in using the board game accessory 10 of the present invention. More specifically, another benefit using freely rolling diametrically magnetized magnets housed with the frame 12 allows the board game accessory to be stacked upon each other and held in place by the magnets 22 in addition to the side by side connection described above. This magnetic stacking allows for easy storage of a plurality of the board game accessory pieces when not in use.

In summary, use of the board game accessory 10 during the playing of the game "The Settlers Of Catan" keeps the game board to stay together wherein most players go through more than one game in an evening, so creating new layouts of the tiles in between each game is made much easier using the board game accessory 10 of the present invention. Additionally, the board game accessory 10 makes the initial setup of the game much easier and less time consuming. Lastly, the game tiles may be laid out in any formation the player's desire (i.e. it doesn't have to be a relatively symmetrical pattern) and the board game accessory 10 help to keep these layouts from falling apart during game play.

It is contemplated for embodiments of the invention to extend to individual elements and concepts described herein, independently of other concepts, ideas or system, as well as for embodiments to include combinations of elements recited anywhere in this application. Although illustrative embodiments of the invention have been described in detail herein with reference to the accompanying drawings, it is to be understood that the invention is not limited to those precise embodiments. As such, many modifications and variations will be apparent to practitioners skilled in this art. Accordingly, it is intended that the scope of the invention be defined by the following claims and their equivalents. Furthermore, it is contemplated that a particular feature described either individually or as part of an embodiment can be combined with other individually described features, or parts of other embodiments, even if the other features and embodiments make no mention of the particular feature.

What is claimed is:

1. A board game accessory for use in holding and displaying hexagonally shaped tile pieces comprising a hexagonally shaped frame defining interiorly shaped holding portions along each side of its frame for use in supporting the tile pieces, wherein said hexagonally shaped frame interiorly houses diametrically magnetized solid cylindrical two-pole magnets within each side of its frame such that said hexagonally shaped frame may be magnetically connected and held in place when located adjacent to another said hexagonally shaped frame, wherein said magnets are housed in cavities defined interiorly within said frame and dimensioned to allow said magnets to roll into a position for magnetic attraction to occur.

2. The board game accessory according to claim 1, wherein said magnets are held in place by use of a lid that is secured to said frames bottom by use of an adhesive.

3. The board game accessory according to claim 1, said hexagonally shaped frame defines three interior cavities that houses said diametrically magnetized solid cylindrical magnets with use of a matching lid.

4. The board game accessory to claim 1, wherein said diametrically magnetized solid cylindrical magnets allow said frame to be stacked one upon the other for storing multiple board game accessory pieces when not in use.

5. The board game accessory according to claim 1, wherein said interiorly shaped holding portions allow for easy removal and replacement of the tile pieces during game play.

6. The board game accessory according to claim 1, wherein said hexagonally shaped frame defining interiorly shaped holding portions along each side of its frame are dimensioned for supporting the tile pieces.

7. The board game accessory according to claim 1, wherein said hexagonally shaped frame, holding portions and lids may be fabricated from plastic.

8. The board game accessory according to claim 1, wherein each said diametrically magnetized solid cylindrical two-pole magnets have a dimension of ⅛"×¼".

9. The board game accessory according to claim 1, wherein said hexagonally shaped frame, holding portions and lids may be fabricated from wood.

10. The board game accessory according to claim 1, wherein said hexagonally shaped frame defines three interior cavities wherein one of said cavities houses said diametrically magnetized solid cylindrical magnets and two other cavities define receptacles for mating to receptacles of a matching lid portion for permanently housing said magnets.

11. The board game accessory according to claim 1, wherein said hexagonally shaped frame defines a plurality of interior cavities for permanently housing in association with matching lids said diametrically magnetized solid cylindrical magnets.

* * * * *